US011259670B2

(12) United States Patent
Joseph

(10) Patent No.: US 11,259,670 B2
(45) Date of Patent: Mar. 1, 2022

(54) WEARABLE DISPENSING DEVICE

(71) Applicant: The Boeing Company, Chicago, IL (US)

(72) Inventor: Joel Joseph, Mill Creek, WA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 16/868,758

(22) Filed: May 7, 2020

(65) Prior Publication Data

US 2021/0345836 A1 Nov. 11, 2021

(51) Int. Cl.

| | |
|---|---|
| ***A45F 3/16*** | (2006.01) |
| ***A47K 5/12*** | (2006.01) |
| ***A47K 5/122*** | (2006.01) |
| ***A44C 5/00*** | (2006.01) |

(52) U.S. Cl.

CPC ..... *A47K 5/1201* (2013.01); *A44C 5/0023* (2013.01); *A44C 5/0084* (2013.01); *A47K 5/122* (2013.01)

(58) Field of Classification Search

CPC .... A47K 5/1201; A47K 5/122; A44C 5/0023; A44C 5/0084

See application file for complete search history.

(56) References Cited

U.S. PATENT DOCUMENTS 5,645,404 A * 7/1997 Zelenak ..... B62J 11/00 417/1
6,126,041 A * 10/2000 DiTomasso ..... A45F 3/20 222/175
6,247,619 B1 * 6/2001 Gill ..... B62J 9/26 222/105
8,622,262 B2 * 1/2014 Van Art ..... A45F 5/00 224/148.2
2002/0177817 A1 * 11/2002 Daniels ..... A61M 25/02 604/179
2004/0045980 A1 * 3/2004 Robins ..... A45F 3/16 222/63
2004/0162534 A1 * 8/2004 Powers ..... A47K 5/122 604/310
2004/0204207 A1 * 10/2004 Parker ..... A42B 1/245 455/575.2
2010/0282182 A1 * 11/2010 Moinester ..... A01K 13/001 119/604
2012/0282011 A1 * 11/2012 Francois ..... A61L 2/18 401/196

(Continued)

*Primary Examiner* — Vishal Pancholi
*Assistant Examiner* — Bob Zadeh
(74) *Attorney, Agent, or Firm* — Quinn IP Law

(57) ABSTRACT

A wearable dispensing device includes a pouch made of a flexible material and having opposed first and second walls defining an interior configured for containing a fluid therein, the pouch further including an outlet port in fluid communication with the interior. A support has a first portion attached to the pouch and a second portion contiguous with the first portion, with the second portion being configured for attachment of the pouch to an outer surface of a human wearer. A dispensing tube has a first end in fluid communication with the outlet port and a second end configured for fluid dispensing. A kit for assembling the wearable dispensing device and a method of operating the wearable dispensing device are also disclosed.

19 Claims, 7 Drawing Sheets

(56) References Cited

U.S. PATENT DOCUMENTS

| | | | | |
|---|---|---|---|---|
| 2016/0044997 | A1* | 2/2016 | Horgan | A45F 5/00 222/175 |
| 2017/0156454 | A1* | 6/2017 | Abadi | A47K 5/1204 |
| 2017/0311781 | A1* | 11/2017 | O'Brien | A61M 5/14 |
| 2019/0150598 | A1* | 5/2019 | Soley | B62J 99/00 |

* cited by examiner

WEARABLE DISPENSING DEVICE

INTRODUCTION

This disclosure relates generally to wearable dispensing devices, kits for assembling a wearable dispensing device and methods of operating a wearable dispensing device.

In some situations and environments, it is beneficial for a human worker to maintain a desired level of hand hygiene. One such situation is surgery, which is typically performed in a controlled environment. However, other situations involve environments that are not as controllable, such as in so-called "first responder" and "essential services" situations which may involve possible exposure to various contaminants. In such situations and environments, there is a need for instant and reliable hand sanitization.

SUMMARY

According to one embodiment, a wearable dispensing device includes: a pouch made of a flexible material and having opposed first and second walls defining an interior configured for containing a fluid therein, the pouch further including an outlet port in fluid communication with the interior; a support having a first portion thereof attached to the pouch and a second portion thereof contiguous with the first portion and configured for attachment of the pouch to an outer surface of a human wearer; and a dispensing tube having a first end in fluid communication with the outlet port and a second end configured for fluid dispensing.

The pouch may further include an inlet port in fluid communication with the interior for admitting fluid into the interior. The fluid may be at least one of a sanitizing fluid, a disinfectant, and a liquid soap. The pouch may be configured to be worn on at least one of an inner side of a forearm, an outer side of the forearm, an inner side of an upper arm, an outer side of the upper arm, a surface of a head, and a lateral side of a torso. In one aspect, the pouch may be configured for attachment to an arm or a torso of the human wearer, and for being squeezed by the human wearer between the arm and the torso.

The wearable dispensing device may further include a bracelet attached proximate the second end of the dispensing tube, wherein the bracelet is configured for constraining the second end proximate a hand of the human wearer. The bracelet may have an open configuration in which the bracelet is generally C-shaped, or a closeable configuration in which the bracelet is configured for closure in a general O-shape. The bracelet may be slidably attached to the dispensing tube.

The dispensing tube may be configured for disposing the second end of the dispensing tube proximate a hand of the human wearer. The wearable dispensing device may further include a dispensing tip disposed at the second end of the dispensing tube, and may further include a check valve disposed proximate the dispensing tip.

The wearable dispensing device may further include an actuator configured for decreasing a volume of the interior so as to urge a fluid flow from the interior to the second end of the dispensing tube. The wearable dispensing device may further include a voice-activated control device configured for receiving a voice command from the human wearer and providing an actuation signal to the actuator based on the voice command for decreasing the volume of the interior and urging the fluid flow.

According to another embodiment, a kit for assembling a wearable dispensing device includes: a pouch made of a flexible material and having opposed first and second walls defining an interior configured for containing a fluid therein, the pouch further including an outlet port in fluid communication with the interior; a support having a first portion configured for attachment to the pouch and a second portion contiguous with the first portion and configured for attachment of the pouch to an outer surface of a human wearer; and a dispensing tube having first and second ends, wherein the first end is configured for fluid engagement with the outlet port and the second end is configured for fluid dispensing. The kit may also include a bracelet configured for attachment proximate the second end of the dispensing tube, wherein the bracelet is further configured for constraining the second end proximate a hand of the human wearer. The kit may further include an actuator configured for engagement with the pouch and for decreasing a volume of the interior so as to urge a fluid flow through the outlet port. In this arrangement, the kit may further include a voice-activated control device configured for receiving a voice command from the human wearer and providing an actuation signal to the actuator based on the voice command for decreasing the volume of the interior and urging the fluid flow.

According to yet another embodiment, a method of operating a wearable dispensing device is disclosed, in which the wearable dispensing device includes a pouch having opposed first and second walls defining an interior containing a fluid therein, a support having a first portion attached to the pouch and a second portion contiguous with the first portion, and a dispensing tube having a first end in fluid communication with an outlet port of the pouch and a second end configured for fluid dispensing. The method includes: (i) attaching the pouch to an outer surface of a human wearer using the second portion of the support; (ii) disposing the second end of the dispensing tube proximate a hand of the human wearer; and (iii) squeezing the pouch so as to urge a flow of the fluid through the dispensing tube and onto the hand of the human wearer. The step of squeezing the pouch may be executed by the human wearer by squeezing the pouch between an arm and a torso of the human wearer. The wearable dispensing device may further include an actuator configured for decreasing a volume of the pouch, and a voice-activated control device configured for receiving a voice command from the human wearer and providing an actuation signal to the actuator. In this configuration, the step of squeezing the pouch may include receiving a voice command from the human wearer, providing an actuation signal to the actuator, and actuating the actuator to decrease the volume of the pouch.

The above features and advantages, and other features and advantages, of the present teachings are readily apparent from the following detailed description of some of the best modes and other embodiments for carrying out the present teachings, as defined in the appended claims, when taken in connection with the accompanying drawings.

DETAILED DESCRIPTION

Figure 1:
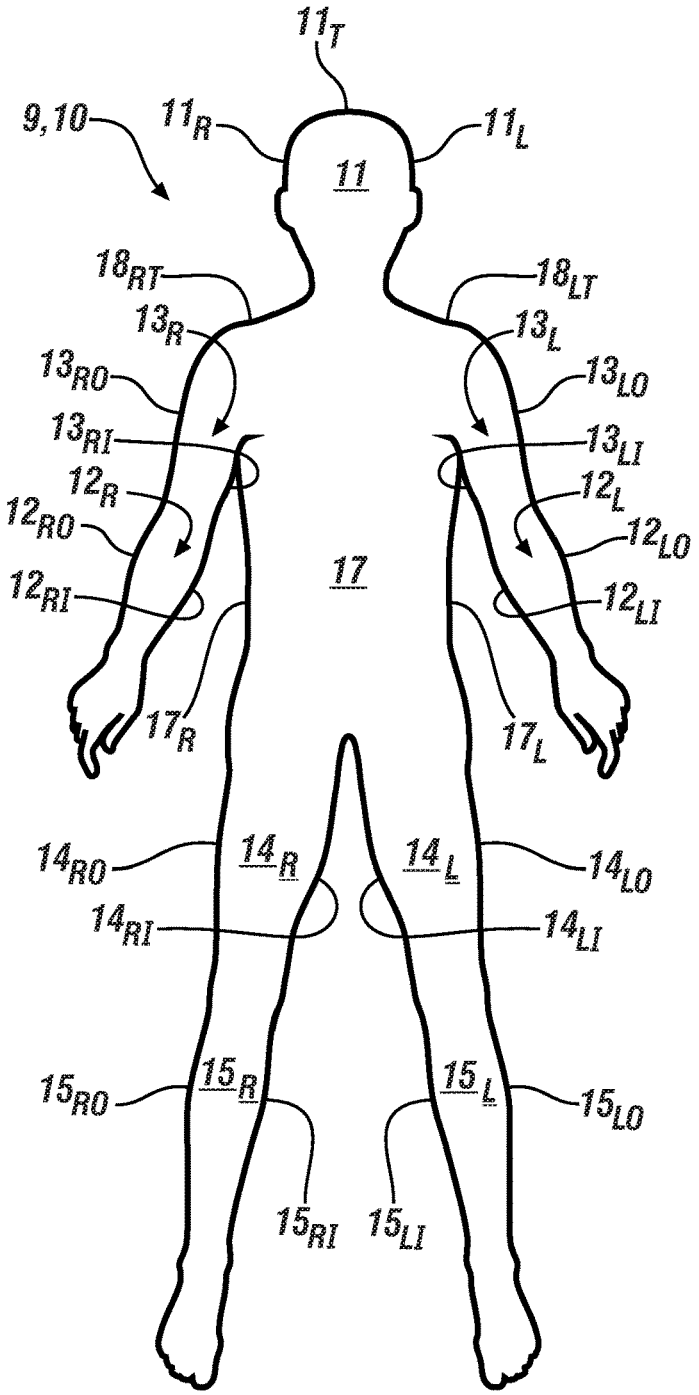
FIGS. 1-3 are front, left side and right side outline views, respectively, of a human body.

Referring now to the drawings, wherein like numerals indicate like parts in the several views, a wearable dispensing device 20, a kit 80 for assembling the wearable dispensing device 20, and a method 100 of operating the wearable dispensing device 20 are shown and described herein. The wearable dispensing device 20, the kit 80 and the method 100 are suitable for use with a variety of dispensable fluids, including sanitizing fluids, disinfectants, liquid soaps, and water. By utilizing the wearable dispensing device 20, the kit 80 and/or the method 100 described herein, a human wearer 10 may carry his/her own supply of dispensable fluids with him/her, which is particularly useful in situations where maintaining hand hygiene is important.

Figure 2:
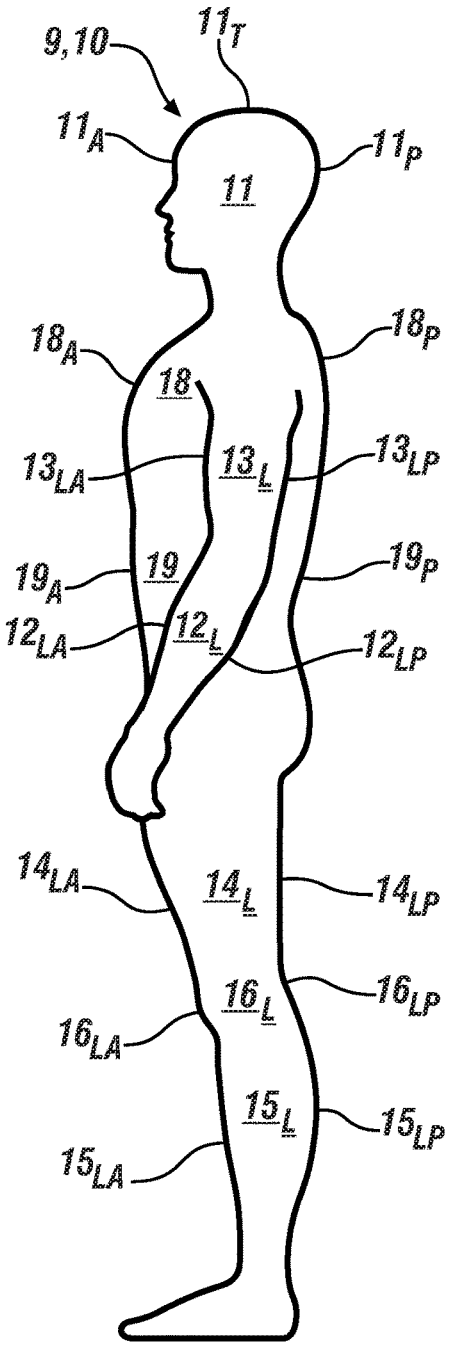
Figure 3:
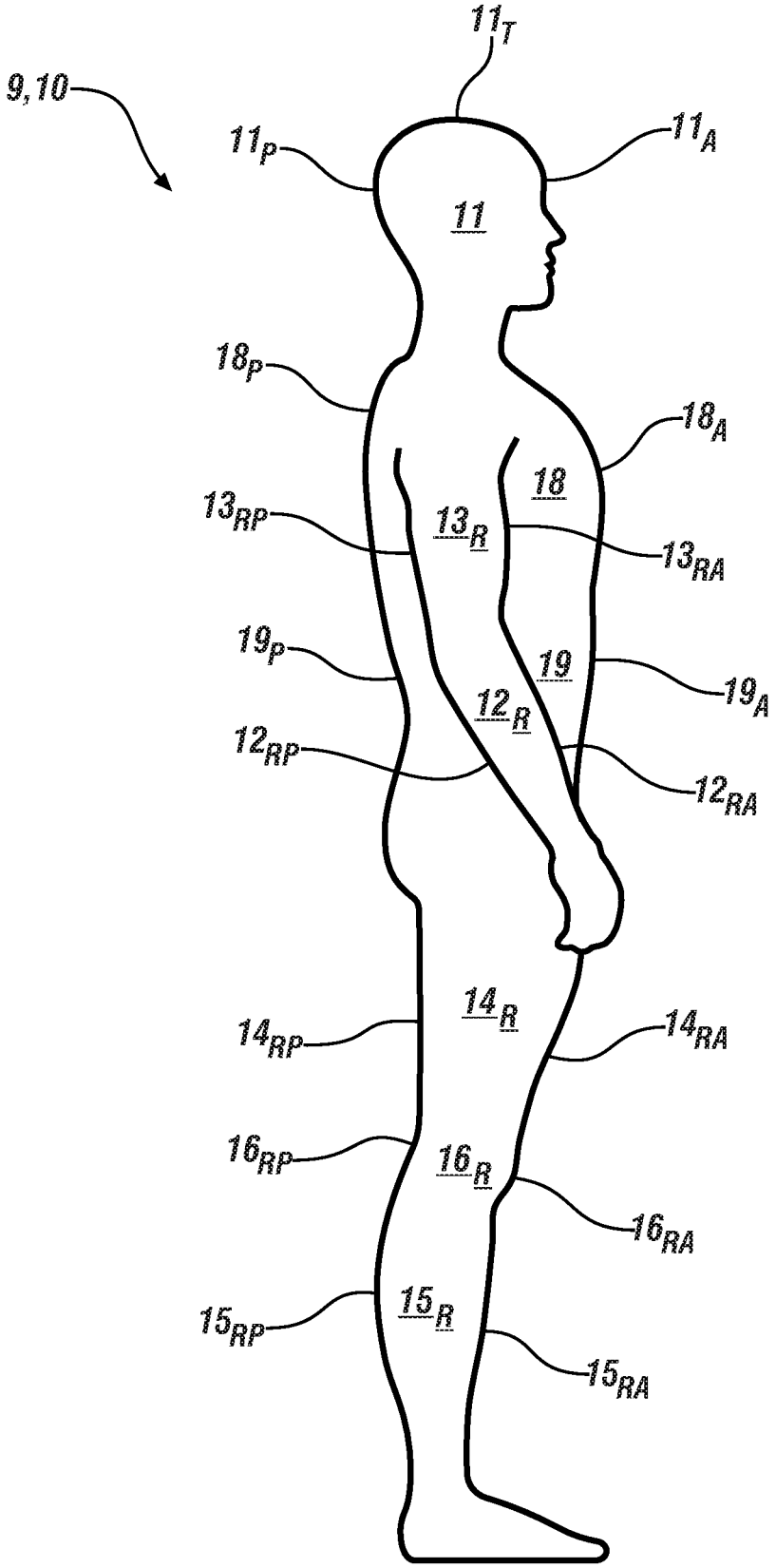

FIGS. 1-3 show front, left side and right side outline views, respectively, of a human body 10. These views illustrate various outer surfaces 9 of a human wearer 10 who may wear the wearable dispensing device 20 on such outer surfaces 9. These outer surfaces 9 include the head 11, the forearm 12, the upper arm 13, the thigh 14, the calf 15, the knee 16, and the torso 17, including the upper torso 18 (including the chest and upper back) and the lower torso 19 (including the stomach area and lower back). Note that these are merely selected exemplary outer surfaces 9 of the human body/human wearer 10, and that other areas may also be utilized for wearing the wearable dispensing device 20, such as the neck/throat area, the elbows, and so forth. Also note that various subscripts have been used to denote specific regions of the body 10; these subscripts and their meanings are summarized below in TABLE 1.

TABLE 1

Subscripts Used in FIGS. 1-3

| Subscript | Meaning |
|---|---|
| T | Top |
| L | Left |
| R | Right |
| A | Anterior (Front) |
| P | Posterior (Rear) |
| I | Inner |
| O | Outer |

Thus, in FIGS. 1-3, reference numerals $\mathbf{11}_T$, $\mathbf{11}_L$, $\mathbf{11}_R$, $\mathbf{11}_A$ and $\mathbf{11}_P$ denote the top, left side, right side, anterior and posterior of the head 11, respectively. Reference numerals $\mathbf{12}_{LI}$, $\mathbf{12}_{LO}$, $\mathbf{12}_{LA}$ and $\mathbf{12}_{LP}$ denote the inner, outer, anterior and posterior areas of the left forearm $\mathbf{12}_L$, respectively, and $\mathbf{12}_{RI}$, $\mathbf{12}_{RO}$, $\mathbf{12}_{RA}$ and $\mathbf{12}_{RP}$ denote the inner, outer, anterior and posterior areas of the right forearm $\mathbf{12}_R$, respectively. Reference numerals $\mathbf{13}_{LI}$, $\mathbf{13}_{LO}$, $\mathbf{13}_{LA}$ and $\mathbf{13}_{LP}$ denote the inner, outer, anterior and posterior areas of the left upper arm $\mathbf{13}_L$, respectively, and $\mathbf{13}_{RI}$, $\mathbf{13}_{RO}$, $\mathbf{13}_{RA}$ and $\mathbf{13}_{RP}$ denote the inner, outer, anterior and posterior areas of the right upper arm $\mathbf{13}_R$, respectively. Reference numerals $\mathbf{14}_{LI}$, $\mathbf{14}_{LO}$, $\mathbf{14}_{LA}$ and $\mathbf{14}_{LP}$ denote the inner, outer, anterior and posterior areas of the left thigh $\mathbf{14}_L$, respectively, and $\mathbf{14}_{RI}$, $\mathbf{14}_{RO}$, $\mathbf{14}_{RA}$ and $\mathbf{14}_{RP}$ denote the inner, outer, anterior and posterior areas of the right thigh $\mathbf{14}_R$, respectively. Reference numerals $\mathbf{15}_{LI}$, $\mathbf{15}_{LO}$, $\mathbf{15}_{LA}$ and $\mathbf{15}_{LP}$ denote the inner, outer, anterior and posterior areas of the left calf $\mathbf{15}_L$, respectively, and $\mathbf{15}_{RI}$, $\mathbf{15}_{RO}$, $\mathbf{15}_{RA}$ and $\mathbf{15}_{RP}$ denote the inner, outer, anterior and posterior areas of the right calf $\mathbf{15}_R$, respectively. Reference numerals $\mathbf{16}_{LA}$ and $\mathbf{16}_{LP}$ denote the anterior and posterior areas of the left knee $\mathbf{16}_L$, respectively. Reference numerals $\mathbf{17}_L$ and $\mathbf{17}_R$ denote the left and right sides of the torso 17, respectively. Reference numerals $\mathbf{18}_A$, $\mathbf{18}_P$, $\mathbf{18}_{LT}$ and $\mathbf{18}_{RT}$ denote the anterior, posterior, left top and right top areas of the upper torso 18, respectively. And reference numerals $\mathbf{19}_A$ and $\mathbf{19}_P$ denote the anterior and posterior areas of the lower torso 19, respectively.

Figure 4:
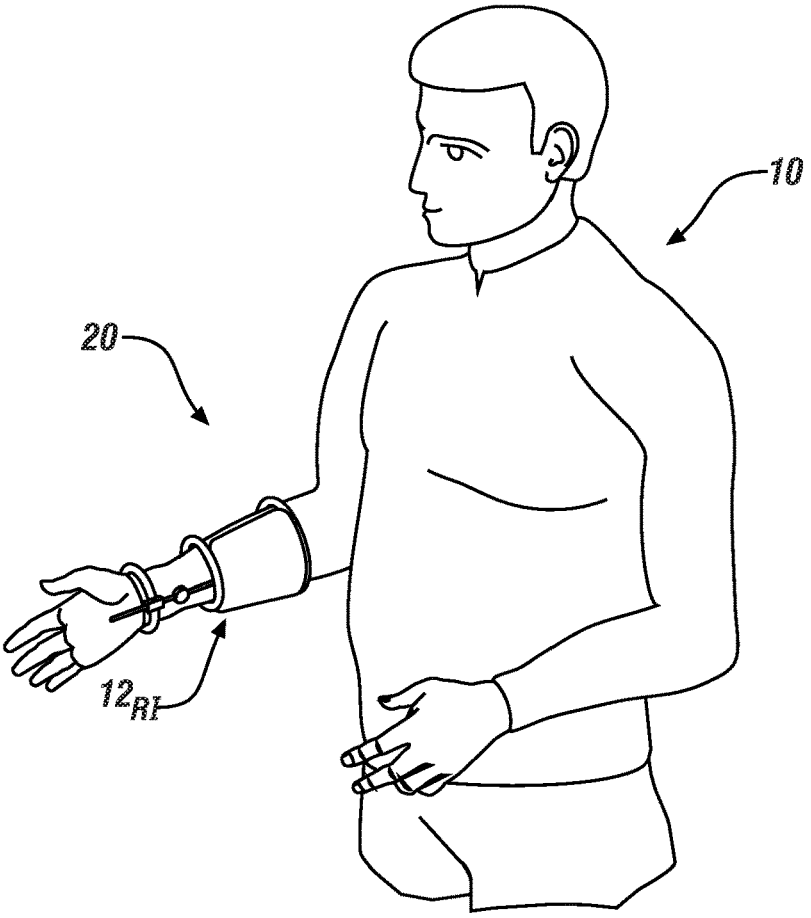
FIG. 4 is a perspective view of the wearable dispensing device worn on an inner forearm of a human wearer.
Figure 5:
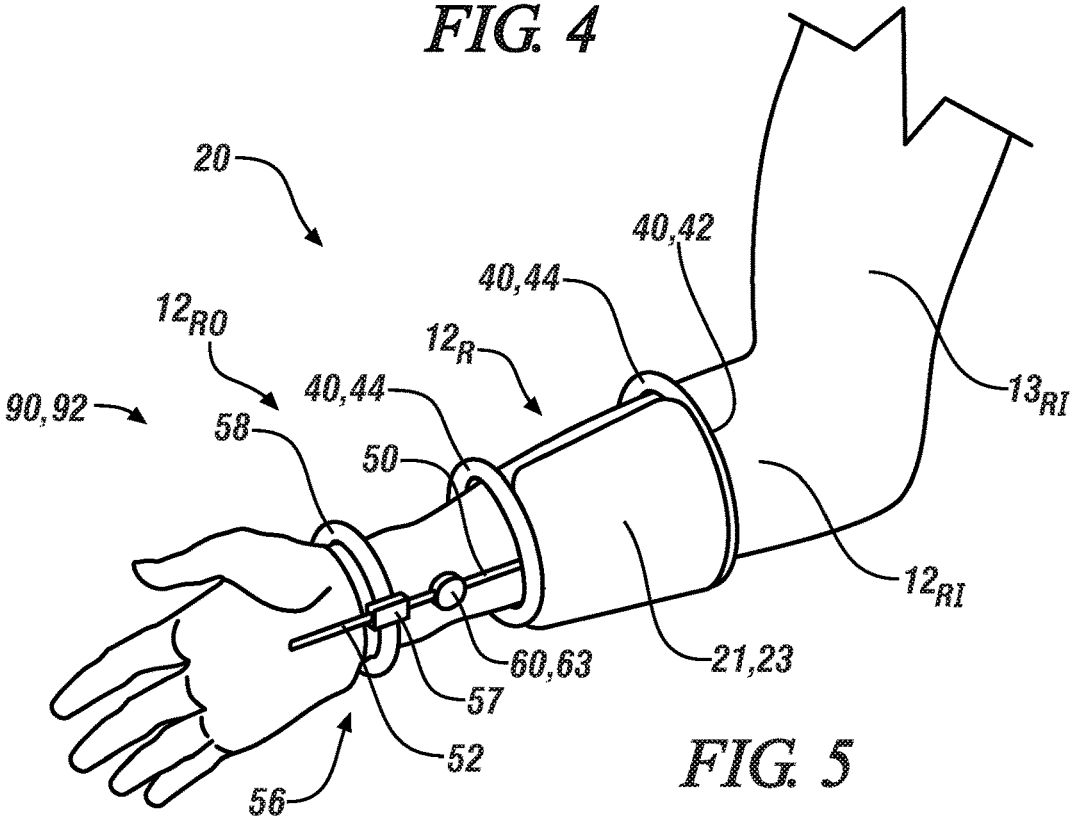
FIG. 5 is a close-up view of the wearable dispensing device shown in FIG. 4.
Figure 6:
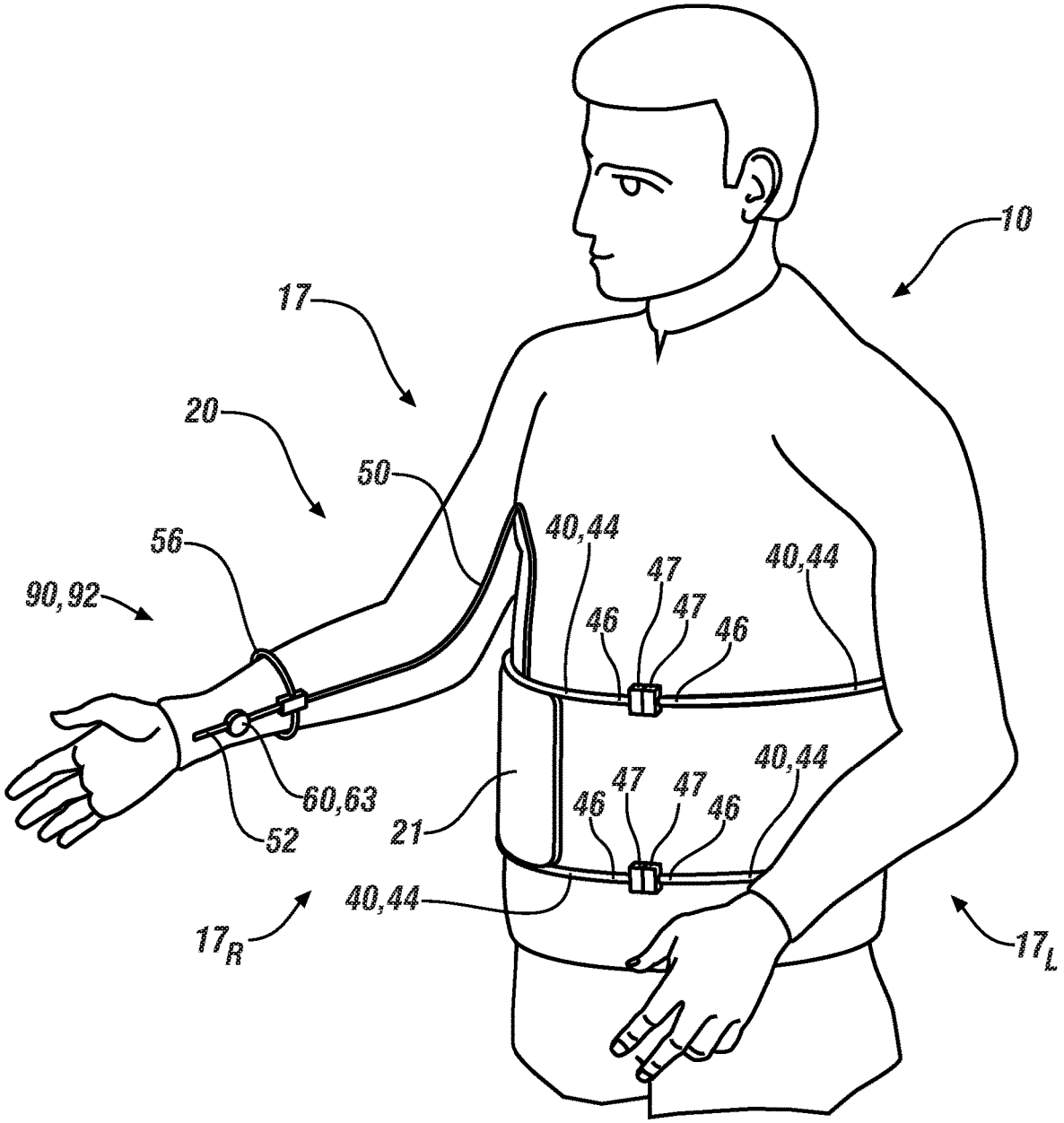
FIG. 6 is a perspective view of the wearable dispensing device worn on a torso of a human wearer.
Figure 8:
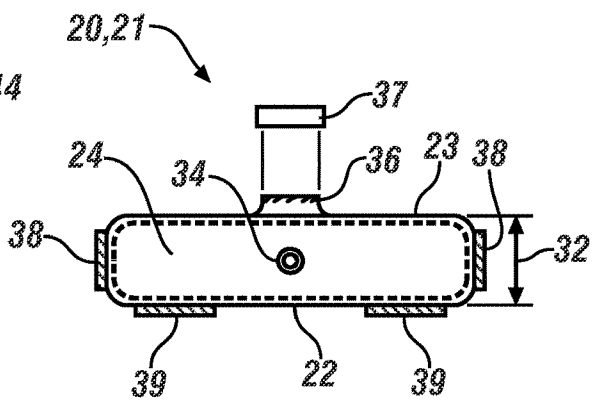
FIG. 8 is a schematic end view of the wearable dispensing device as viewed along line 8-8 of FIG. 7.
Figure 7:
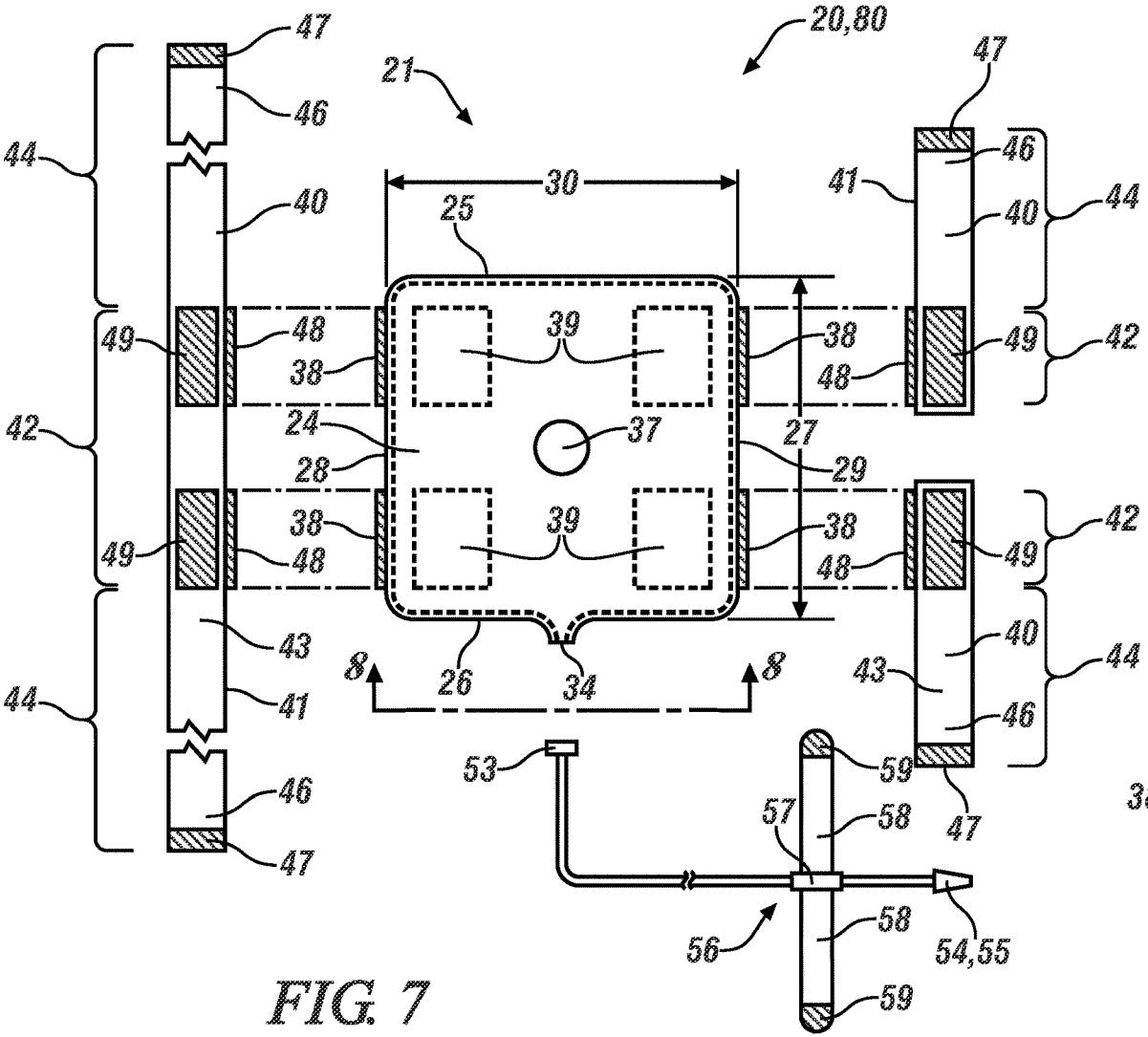
FIG. 7 is a schematic exploded plan view of the wearable dispensing device.

FIGS. 4-5 show perspective and close-up perspective views of the wearable dispensing device 20 being worn on an inner side $\mathbf{12}_{RI}$ of a right forearm $\mathbf{12}_R$, FIG. 6 shows a perspective view of the wearable dispensing device 20 being worn about a torso 17, and FIGS. 7-8 show schematic exploded plan and end views of the wearable dispensing device 20. As illustrated in the drawings, the wearable dispensing device 20 includes a pouch or container 21 made of a flexible material and having opposed first and second walls 22, 23 defining an inner chamber or interior 24 configured for containing a fluid therein, such as a sanitizing fluid, a disinfectant or a liquid soap. Exemplary materials for constructing the pouch 21 include plastics, elastomers, and plastic- or elastomer-coated metal foils. The pouch 21 may have a generally rectangular or other overall shape having opposed first and second ends 25, 26 defining an overall length 27, opposed first and second sides 28, 29 defining an overall width 30, and a thickness 32 defined by the first and second walls 22, 23.

The pouch 21 may include an inlet port 36 in fluid communication with the interior 24 for admitting fluid into the interior 24, such as for filling and refilling the pouch 21 with a fluid. A lid, cap or other removable covering 37 may be used to engage with the inlet port 36 to keep the fluid inside the interior 24. The pouch 21 further includes an outlet port 34 in fluid communication with the interior 24. The outlet port 34 may be configured for dispensing fluid therethrough and may include a special fitting to engage with other components and/or with lids or caps. This special fitting may include screw threads, quick-disconnect fittings or the like, and may optionally include a check valve or other one-way valve to permit the fluid to flow out through the outlet port 34 while preventing inward flow toward the interior 24.

The wearable dispensing device 20 also includes one or more supports 40 for attaching the pouch 21 to an outer surface 9 of a human wearer 10. Each support 40 has a first portion 42 thereof attached to the pouch 21, and a second portion 44 thereof contiguous with the first portion 42 and configured for attachment of the pouch 21 to an outer surface 9 of a human wearer 10. Each of the one or more supports 40 may be a flexible strap or band, or a generally rigid elongate member, and each support 40 may extend around a portion or an entirety of the outer surface 9 or body area of the human wearer 10.

For example, in the configuration shown in FIGS. 4-5 (along with reference to FIGS. 7-8), the pouch 21 and the first portion 42 of each support 40 may cover the inner right forearm $\mathbf{12}_{RI}$, and the second portion 44 of each support 40 may extend about some or all of the outer right forearm $12_{RO}$. In cases of this configuration where the supports 40 do not go all the way around the right forearm $12_R$, the supports 40 may be generally C-shaped rigid members that are effective to hold the pouch 21 on the right forearm $12_R$ once the wearable dispensing device 20 is disposed onto the right forearm $12_R$. However, in cases of this configuration where the supports 40 do go all the way around the right forearm $12_R$, the supports 40 may be flexible straps having fasteners 47 on the distal ends 46 of the second portions 44. Each of these fasteners 47 may connect with other corresponding or mating fasteners 47 on the distal ends 46 of other second portions 44, or they may connect with corresponding or mating fasteners 39 located on one or more of the first and second walls 22, 23 and the first and second ends 25, 26.

As another example, in the configuration shown in FIG. 6 (along with reference to FIGS. 7-8), the pouch 21 and the first portion 42 of each support 40 may cover the right side $17_R$ of the torso 17, and the second portions 44 of the supports 40 may extend about the entire torso 17 of the human wearer 10. Here, two supports 40 are provided, with each support 40 having a respective first portion 42 attached to the pouch 21, a respective "short" second portion 44 wrapping around the right-front portion of the torso 17, and a respective "long" second portion 44 wrapping around the back and left-front portions of the torso 17. Each of the respective short and long second portions 44 of each support 40 terminate in a respective fastener 47, and these respective fasteners 47 connect with each other.

In configurations where one or more supports 40 are flexible straps or bands, such supports 40 may include slip locks or strap adjusters to allow the length of each strap or band to be adjusted. As illustrated in FIGS. 7-8, the supports 40 may be separable from the pouch 21, and may be attached to the pouch 21 by connecting (i) fasteners 48 located on the edge 41 of a support 40, or fasteners 49 located on the face 43 of a support 40, with (ii) fasteners 38 located on a first or second side 28, 29 of the pouch 21, or fasteners 39 located on a first or second wall 22, 23 of the pouch 21. These various fasteners 38, 39, 47, 48, 49 may take the form of buckles, snaps, hook-and-loop fasteners, or the like. FIG. 7 illustrates one of the many possible configurations of the one more supports 40 and the associated fasteners 38, 39, 47, 48, 49. Here, the first side 28 of the pouch 21 is associated with a single support 40 having one first portion 42 and two opposed second portions 44, while the second side 29 is associated with two separate supports 40 with each having a respective first portion 42 and a respective second portion 44. Note that while reference numerals 38, 39, 48 and 49 may be used to represent fastenable and unfastenable fasteners such as buckles, snaps, and hook-and-loop elements, thus making the pouch 21 and the supports 40 fastenable and unfastenable with respect to each other, these reference numerals 38, 39, 48, 49 may also be used to represent locations at which the pouch 21 and the supports 40 may be permanently or semi-permanently fastened to each other, such as by being sewn, glued or riveted together at such locations 38, 39, 48, 49.

In conjunction with the one or more supports 40, the pouch 21 may be configured, sized and shaped to be worn on one or more outer surfaces 9 of a human wearer 10. As described above, these outer surfaces 9 may include an inner side of a forearm $12_{LI}$, $12_{RI}$, an outer side of the forearm $12_{LO}$, $12_{RO}$, an inner side of an upper arm $13_{LI}$, $13_{RI}$, an outer side of the upper arm $13_{LO}$, $13_{RO}$, a surface of the head $11_T$, $11_L$, $11_R$, $11_A$, $11_P$, and a lateral side of a torso $17_L$, $17_R$, as well as anterior and posterior areas of the forearm $12_{LA}$, $12_{LP}$, $12_{RA}$, $12_{RP}$, the upper arm $13_{LA}$, $13_{LP}$, $13_{RA}$, $13_{RP}$, the thigh $14_{LA}$, $14_{LP}$, $14_{RA}$, $14_{RP}$, the calf $15_{LA}$, $15_{LP}$, $15_{RA}$, $15_{RP}$, the knee $16_{LA}$, $16_{LP}$, $16_{RA}$, $16_{RP}$, the upper torso $18_A$, $18_P$ and the lower torso $19_A$, $19_P$. In one aspect, the pouch 21 may be configured for attachment to a forearm $12_L$, $12_R$, an upper arm $13_L$, $13_R$ or a torso 17 of the human wearer 10, and for being squeezed by the human wearer 10 between the forearm/upper arm $12_L$, $12_R$, $13_L$, $13_R$ and the torso 17.

The wearable dispensing device 20 further includes a dispensing tube 50 having a first end 51 in fluid communication with the outlet port 34 and a second end 52 configured for fluid dispensing. The dispensing tube 50 may include an appropriate fitting 53 on the first end 51 so that the dispensing tube 50 may sealably engage with the outlet port 34. The dispensing tube 50 may be configured for disposing the second end 52 of the dispensing tube 50 proximate a hand of the human wearer 10. The wearable dispensing device 20 may further include a dispensing tip 54 (e.g., a sprayer or atomizer) disposed at the second end 52 of the dispensing tube 50. The wearable dispensing device 20 may also include a check valve 55 disposed somewhere along the length of the dispensing tube 50, such as proximate the dispensing tip 54. The dispensing tube 50 may be provided with sufficient length such that it may be arranged comfortably by the human wearer 10 for use in various situations.

The wearable dispensing device 20 may further include a bracelet or wristband 56 attached proximate the second end 52 of the dispensing tube 50. The bracelet 56 may be configured for constraining and/or positioning the second end 52 of the dispensing tube 50 proximate a hand of the human wearer 10. In this arrangement, when the pouch 21 is squeezed, fluid may be dispensed out of the second end 52 of the dispensing tube 50 and onto the wearer's hand. In one exemplary arrangement, the second end 52 may be disposed and constrained by the bracelet 56 on the inner side of the forearm $12_{LI}$, $12_{RI}$, so that dispensed fluid is directed into the palm of the wearer's hand.

The bracelet 56 may have an open configuration 90 in which the bracelet 56 is generally C-shaped, or a closeable configuration 92 in which the bracelet 56 is configured for closure in a general O-shape. The bracelet 56 may include a body portion 57 which attaches to or is constrained about the dispensing tube 50, with one or more extending portions 58 attached to and extending outward from the body portion 57. For example, each extending portion 58 may be a flexible strap or band with a suitable fastener 59 (e.g., snaps, hook-and-loop fasteners, etc.) on the distal end thereof (for closeable configurations 92), or a generally rigid support or finger (for open configurations 90), which may be wrapped around some portion or an entirety of a wrist of the human wearer 10. The bracelet 56 may be slidably attached to the dispensing tube 50, such as by the body portion 57 being slidably wrapped or disposed about the dispensing tube 50. This slidable aspect enables the bracelet 56 to be disposed at a comfortable position on a wearer's forearm $12_L$, $12_R$, and may also enable the dispensing tube 50 to be slid through the body portion 57 so that the second end 52 may be disposed proximate the wearer's hand.

Figure 9:
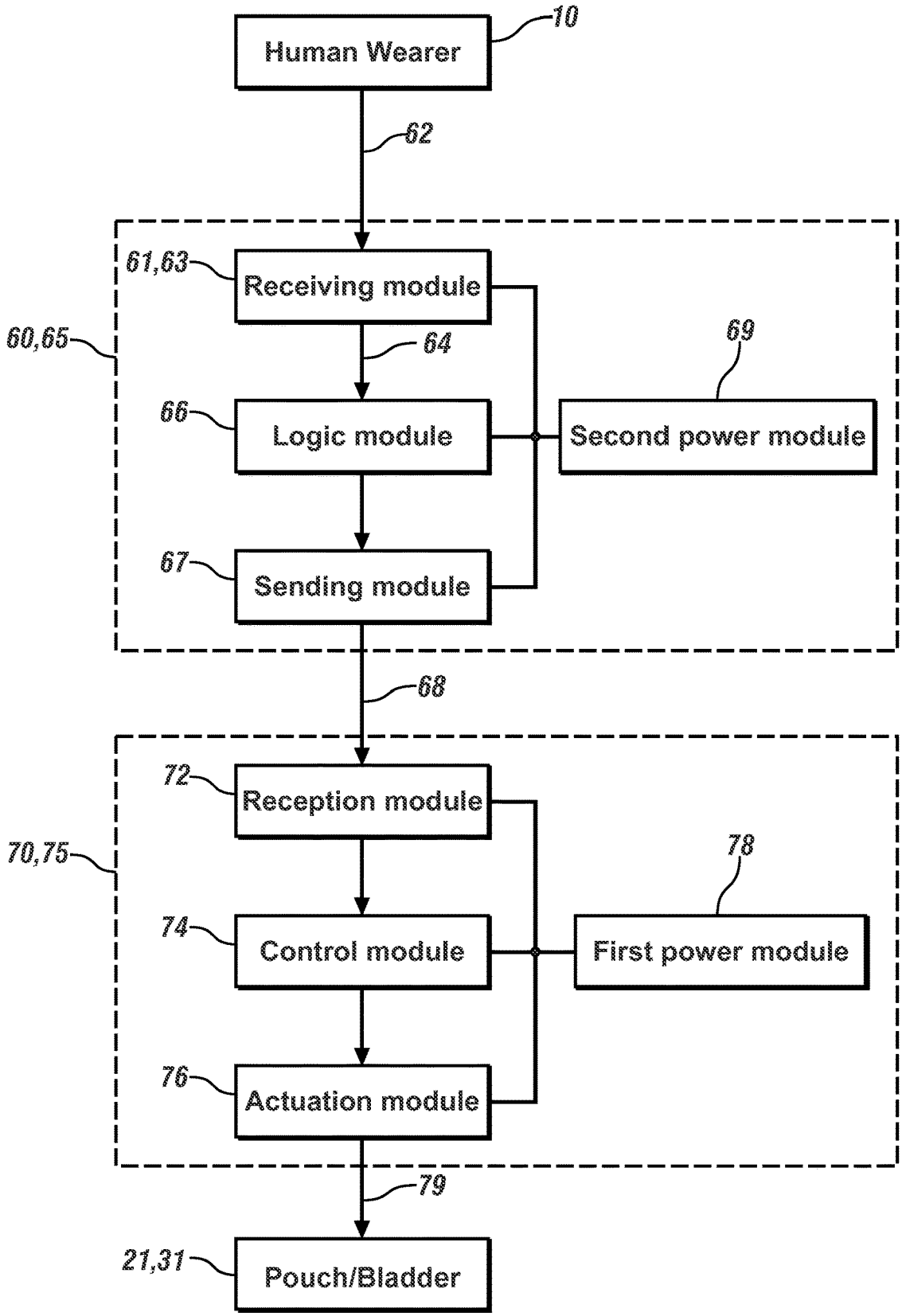
FIG. 9 is a block diagram of a voice-activated control device and an actuator for use with the wearable dispensing device.
Figure 10:
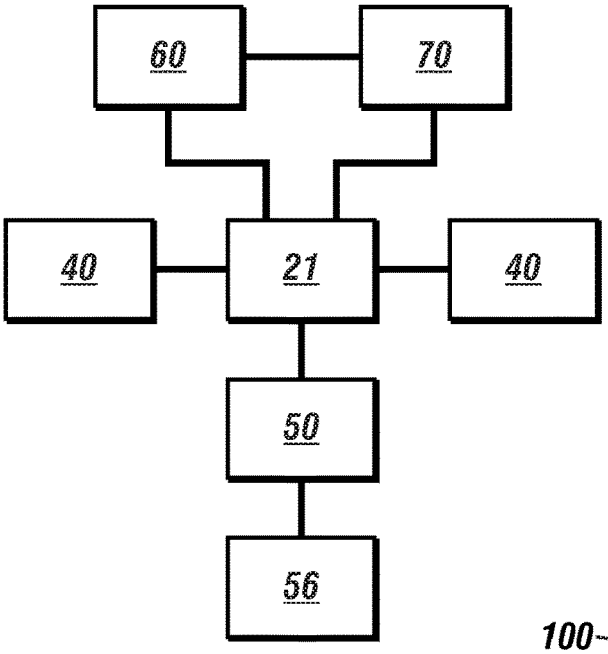
FIG. 10 is a block diagram of the wearable dispensing device incorporating a voice-activated control device and an actuator.

As illustrated in FIGS. 9-10, the wearable dispensing device 20 may further include an actuator 70 configured for decreasing a volume of the interior 24 of the pouch 21 so as to urge a fluid flow from the interior 24 to the second end 52 of the dispensing tube 50. The actuator 70 may decrease the volume of the interior 24 of the pouch 21 by squeezing or compressing the pouch 21 (e.g., by acting on and bringing together the first and second walls 22, 23, the first and second ends 25, 26, and/or the first and second sides 28, 29), or by expanding an internal bladder 31 disposed within the interior 24. Such action by the actuator 70 may be accomplished by one or more motors, gears, linkages and other electro-mechanical elements. As illustrated in FIG. 9, the actuator 70 may include a reception module 72 configured to receive an actuation request or signal 68, such as from a push button, a sensor, a voice-activated control device 60, or the like. The reception module 72 communicates with a control module 74 which interprets or verifies the actuation signal 68 (e.g., to make sure it is a valid signal according to predetermined parameters), and upon verification that the actuation signal 68 is valid, the control module 74 communicates a signal with an associated actuation module 76 to cause actuation of the actuation module 76, thereby producing an action or result 79 (e.g., reducing the volume of the pouch 21). A first power module 78 may provide power to each of the reception module 72, the control module 74 and the actuation module 76, and some or all of these modules 72, 74, 76, 78 may be housed in a first hardware unit 75, such as an enclosure or housing.

The wearable dispensing device 20 may further include a voice-activated control device (VCD) 60 configured for receiving a voice command 62 from the human wearer 10 and providing an actuation signal 68 to the actuator 70 based on the voice command 62, for the purpose of decreasing the volume of the interior 24 and urging fluid flow. The VCD 60 may include a receiving module 61, which may include a microphone 63 and other circuitry. The receiving module 61 may pass the voice command 62 along a connection 64 (e.g., wire, circuitry, wireless coupling) to a logic module 66 which interprets or verifies the voice command 62. For example, the logic module 66 may verify that the voice command 62 uses a valid predetermined word or phrase and/or that the voice command 62 is issued by a valid user. The logic module 66 may then communicate with a sending module 67 configured to issue an actuation signal 68 for the actuator 70. A second power module 69 may provide power to each of the receiving module 61, the logic module 66 and the sending module 67, and some or all of these modules 61, 66, 67, 69 may be housed in a second hardware unit 65, such as an enclosure or housing.

FIG. 10 shows a block diagram of the wearable dispensing device 20 incorporating a VCD 60 and an actuator 70. As illustrated here, the pouch 21 is connected with a dispensing tube 50, one or more supports 40, a VCD 60 and an actuator 70. The dispensing tube 50 may also be connected with one or more bracelets 56 for disposing the second end 52 of the dispensing tube 50 proximate a hand of the human wearer 10. And as described above, the VCD 60 and actuator 70 may be connected with each other, such that an actuation signal 68 may be passed from the VCD 60 to the actuator 70. Note that any of the functionalities of any element in the block diagram may be moved or combined with other functionalities of other elements in the block diagram. For example, either or both of the first and second power modules 78, 69 may be located outside of their respective first or second hardware units or enclosures 65, 75. Also, both of the first and second power modules 78, 69 may be located in the first hardware unit 75 or the in the second hardware unit 65. Further, a single power supply may be used to provide the functionality of both power modules 78, 69. Further, the various functionalities of the receiving module 61, the logic module 66, the sending module 67, the reception module 72, the control module 74 and the actuation module 76 may be moved and/or combined as desired in order to achieve the overall functionality of the wearable dispensing device 20.

FIG. 7 illustrates another embodiment, in which a kit 80 of components is provided for assembling a wearable dispensing device 20. The kit 80 includes: (i) a pouch 21 made of a flexible material and having opposed first and second walls 22, 23 defining an interior 24 configured for containing a fluid therein, the pouch 21 further including an outlet port 34 in fluid communication with the interior 24; (ii) a support 40 having a first portion 42 configured for attachment to the pouch 21 and a second portion 44 contiguous with the first portion 42 and configured for attachment of the pouch 21 to an outer surface 9 of a human wearer 10; and a (iii) dispensing tube 50 having first and second ends 51, 52, wherein the first end 51 is configured for fluid engagement with the outlet port 34 and the second end 52 is configured for fluid dispensing. The kit 80 may further include a bracelet 56 configured for attachment proximate the second end 52 of the dispensing tube 50. The bracelet 56 may also be configured for constraining the second end 52 proximate a hand of the human wearer 10. The kit 80 may further include an actuator 70 configured for engagement with the pouch 21 and for decreasing a volume of the interior 24 so as to urge a fluid flow through the outlet port 34. In this arrangement, the kit 80 may further include a voice-activated control device 60 configured for receiving a voice command 62 from the human wearer 10 and providing an actuation signal 68 to the actuator 70 based on the voice command 62 for decreasing the volume of the interior 24 and urging the fluid flow through the outlet port 34. These items in the kit 80 may be easily assembled to provide a wearable dispensing device 20 for dispensing sanitizing fluids or other fluids.

Figure 11:
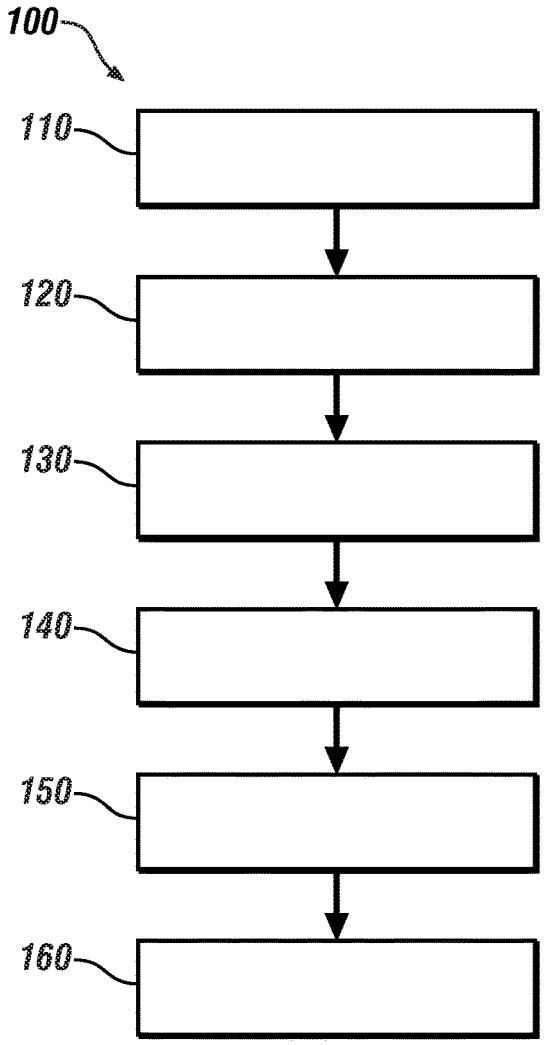
FIG. 11 is a flowchart for a method of operating the wearable dispensing device.

FIG. 11 illustrates yet another embodiment, in which a method 100 of operating a wearable dispensing device 20 is disclosed. At block 110, a wearable dispensing device 20 is provided in a "basic" configuration, which includes a pouch 21 having opposed first and second walls 22, 23 defining an interior 24 containing a fluid therein, a support 40 having a first portion 42 attached to the pouch 21 and a second portion 44 contiguous with the first portion 42, and a dispensing tube 50 having a first end 51 in fluid communication with an outlet port 34 of the pouch 21 and a second end 52 configured for fluid dispensing. In an "enhanced" configuration, the wearable dispensing device 20 may further include an actuator 70 configured for decreasing a volume of the pouch 21, and a voice-activated control device 60 configured for receiving a voice command 62 from the human wearer 10 and providing an actuation signal 68 to the actuator 70. At block 120, the pouch 21 is attached to an outer surface 9 of a human wearer 10 using the second portion 44 of the support 40. At block 130, the second end 52 of the dispensing tube 50 is disposed proximate a hand of the human wearer 10. After block 130, the process flow for the "basic" configuration may skip blocks 140 and 150, while the process flow for the "enhanced" configuration may include blocks 140 and 150. At block 140, a voice command 62 is received from the human wearer 10 (such as by the VCD 60). At block 150, an actuation signal 68 is provided to the actuator 70. And at block 160, the pouch 21 is squeezed so as to urge a flow of the fluid through the dispensing tube 50 and onto the hand of the human wearer 10. Note that in both the "basic" and "enhanced" configurations, the step of squeezing the pouch 21 at block 160 may be executed by the human wearer 10 by squeezing the pouch 21 between an arm (i.e., a forearm $\mathbf{12}_L$, $\mathbf{12}_R$ or upper arm $\mathbf{13}_L$, $\mathbf{13}_R$) and a torso 17 of the human wearer 10. And in the "enhanced" configuration, the step of squeezing the pouch 21 at block 160 may include actuating the actuator 70 to decrease the volume of the pouch 21.

As described herein, the wearable dispensing device 20 can be easily strapped or affixed onto a forearm $12_L$, $12_R$, torso 17 or other outer surface 9 of a human wearer 10. Whenever it is desired that sanitizing fluid (or other fluid) be dispensed from the pouch 21 into the hand of the human wearer 10, he/she can either squeeze the pouch 21 in a hands-free manner (such as by squeezing the pouch 21 between the forearm $12_L$, $12_R$ and the torso 17); or, if the wearable dispensing device 20 includes a VCD 60 and actuator 70, he/she can cause the fluid to be dispensed by an appropriate voice command 68. In either case, the wearable dispensing device 20, the kit 80 and the method 100 of the present disclosure provide the advantage of hands-free dispensing of the fluid.

The above description is intended to be illustrative, and not restrictive. While the dimensions and types of materials described herein are intended to be illustrative, they are by no means limiting and are merely exemplary embodiments. Many other embodiments will be apparent to those of skill in the art upon reviewing the above description. Moreover, in the following claims, use of the terms "first", "second", "top", "bottom", etc. are used merely as labels, and are not intended to impose numerical or positional requirements on their objects. As used herein, an element or step recited in the singular and preceded by the word "a" or "an" should be understood as not excluding plural of such elements or steps, unless such exclusion is explicitly stated. Additionally, the phrase "at least one of A and B" and the phrase "A and/or B" should each be understood to mean "only A, only B, or both A and B". And when broadly descriptive adverbs such as "substantially" and "generally" are used herein to modify an adjective, these adverbs mean "for the most part", "to a significant extent" and/or "to a large degree", and do not necessarily mean "perfectly", "completely", "strictly" or "entirely". Additionally, the word "proximate" may be used herein to describe the location of an object or portion thereof with respect to another object or portion thereof, and/or to describe the positional relationship of two objects or their respective portions thereof with respect to each other, and may mean "near", "adjacent", "close to", "close by", "at" or the like.

This written description uses examples, including the best mode, to enable those skilled in the art to make and use devices, systems and compositions of matter, and to perform methods, according to this disclosure. It is the following claims, including equivalents, which define the scope of the present disclosure.

What is claimed is:

1. A wearable dispensing device, comprising: a pouch made of a flexible material and having opposed first and second walls defining an interior configured for containing a fluid therein, the pouch further including an outlet port in fluid communication with the interior; a support having a first portion thereof attached to the pouch and a second portion thereof contiguous with the first portion and configured for attachment of the pouch to an outer surface of a human wearer; and a dispensing tube having a first end in fluid communication with the outlet port and a second end configured for fluid dispensing; a check valve disposed in at least one of the dispensing tube and the outlet port; and a bracelet attached proximate the second end of the dispensing tube, wherein the bracelet is configured for constraining the second end of the dispensing tube on an inner side of a forearm; and wherein the bracelet includes a body portion slidably disposed around the dispensing tube.

2. The wearable dispensing device of claim 1, wherein the pouch is configured to be worn on at least one of an inner side of a forearm, an outer side of the forearm, an inner side of an upper arm, an outer side of the upper arm, a surface of a head, and a lateral side of a torso.

3. The wearable dispensing device of claim 1, wherein the pouch is configured for attachment to an arm or a torso of the human wearer and for being squeezed by the human wearer between the arm and the torso.

4. The wearable dispensing device of claim 1, wherein the bracelet is configured for constraining the second end proximate a hand of the human wearer.

5. The wearable dispensing device of claim 4, wherein the bracelet has an open configuration in which the bracelet is generally C-shaped or a closeable configuration in which the bracelet is configured for closure in a general O-shape.

6. The wearable dispensing device of claim 1, wherein the dispensing tube is configured for disposing the second end proximate a hand of the human wearer.

7. The wearable dispensing device of claim 1, further comprising a dispensing tip disposed at the second end of the dispensing tube.

8. The wearable dispensing device of claim 7, wherein the check valve is disposed proximate the dispensing tip.

9. The wearable dispensing device of claim 1, further comprising an electro-mechanical actuator configured for decreasing a volume of the interior so as to urge a fluid flow from the interior to the second end of the dispensing tube.

10. The wearable dispensing device of claim 9, further comprising a voice-activated control device configured for receiving a voice command from the human wearer and providing an actuation signal to the electro-mechanical actuator based on the voice command for decreasing the volume of the interior and urging the fluid flow.

11. The wearable dispensing device of claim 1, wherein the pouch further includes an inlet port in fluid communication with the interior for admitting fluid into the interior.

12. The wearable dispensing device of claim 1, wherein the fluid is at least one of a sanitizing fluid, a disinfectant, and a liquid soap.

13. A kit for assembling a wearable dispensing device, comprising:

a pouch made of a flexible material and having opposed first and second walls defining an interior configured for containing a fluid therein, the pouch further including an outlet port in fluid communication with the interior;

a support having a first portion configured for attachment to the pouch and a second portion contiguous with the first portion and configured for attachment of the pouch to an outer surface of a human wearer;

a dispensing tube having first and second ends, wherein the first end is configured for fluid engagement with the outlet port and the second end is configured for fluid dispensing;

a check valve configured for disposition in at least one of the dispensing tube and the outlet port; and a bracelet configured for attachment proximate the second end of the dispensing tube and for constraining the second end of the dispensing tube on an inner side of a forearm, wherein the bracelet includes a body portion configured for being slidably disposed around the dispensing tube.

14. The kit of claim 13, wherein the bracelet is further configured for constraining the second end proximate a hand of the human wearer.

15. The kit of claim 13, further comprising an electro-mechanical actuator configured for engagement with the pouch and for decreasing a volume of the interior so as to urge a fluid flow through the outlet port.

16. The kit of claim 15, further comprising a voice-activated control device configured for receiving a voice command from the human wearer and providing an actuation signal to the electro-mechanical actuator based on the voice command for decreasing the volume of the interior and urging the fluid flow.

17. A method of operating a wearable dispensing device which includes a pouch having opposed first and second walls defining an interior containing a fluid therein, a support having a first portion attached to the pouch and a second portion contiguous with the first portion, a dispensing tube having a first end in fluid communication with an outlet port of the pouch and a second end configured for fluid dispensing, a check valve disposed in at least one of the dispensing tube and the outlet port, a bracelet configured for attachment proximate the second end of the dispensing tube and for constraining the second end of the dispensing tube on an inner side of a forearm, wherein the bracelet includes a body portion configured for being slidably disposed around the dispensing tube, and an electro-mechanical actuator configured for decreasing a volume of the pouch, comprising:

attaching the pouch to an outer surface of a human wearer using the second portion of the support;

disposing the second end of the dispensing tube proximate a hand of the human wearer; and actuating the actuator to decrease the volume of the pouch, thereby urging a flow of the fluid through the dispensing tube and onto the hand of the human wearer.

18. The method of claim 17, wherein the step of actuating the actuator to decrease the volume of the pouch, thereby urging a flow of the fluid through the dispensing tube and onto the hand of the human wearer, is accomplished by at least one of compressing the pouch by the actuator and expanding an internal bladder within the interior of the pouch by the actuator.

19. The method of claim 17, wherein the wearable dispensing device further includes a voice-activated control device configured for receiving a voice command from the human wearer and providing an actuation signal to the actuator, wherein the method further comprises:

receiving a voice command from the human wearer; and providing an actuation signal to the actuator.

* * * * *